US005632216A

United States Patent [19]

Hair

[11] Patent Number: 5,632,216

[45] Date of Patent: May 27, 1997

[54] EMERGENCY STEERING CONTROL

[76] Inventor: Miles H. Hair, P.O. Box 1215, Elizabethtown, N.C. 28337

[21] Appl. No.: 721,551

[22] Filed: Sep. 26, 1996

Related U.S. Application Data

[63] Continuation of Ser. No. 449,366, May 24, 1995, abandoned.

[51] Int. Cl.[6] ..... B63H 20/08

[52] U.S. Cl. ..... 114/146; 440/6; 74/480 B

[58] Field of Search ..... 114/144 R, 146; 440/6, 53, 62, 63; 74/480 B, 544, 343, 494

[56] References Cited

U.S. PATENT DOCUMENTS

| | | | |
|---|---|---|---|
| 4,262,619 | 4/1981 | Hine | 114/144 R |
| 4,624,206 | 11/1986 | Frye et al. | 114/146 |
| 4,656,960 | 4/1987 | Davenport | 114/144 R |
| 4,735,166 | 4/1988 | Dimalanta | 114/146 |
| 5,052,320 | 10/1991 | Cremer | 440/900 |
| 5,176,549 | 1/1993 | Ross | 440/62 |
| 5,279,242 | 1/1994 | Johnson | 114/144 R |

OTHER PUBLICATIONS

Advertisement appearing in "the Bassin Times" for Dick Watson's Pro's Stick.

Sheet containing an ad from the "Fisherman's Ambassadors Magazine".

*Primary Examiner*—Edwin L. Swinehart

*Attorney, Agent, or Firm*—Olive & Olive P.A.

[57] ABSTRACT

The present invention provides a practical solution to the problem of failure of a pedal operated steering control for a fishing boat trolling motor. The emergency controller has a pair of links inner ends of which mount on the trolling motor support assembly and outer ends of which are secured to a rod. The rod is generally situated at its lower end parallel to a motor mount conduit which supports the electric drive motor and has a handle at its upper end for steering. When mounted on the trolling motor assembly, the emergency controller of the invention provides a simple steering means and may be so mounted while the fishing boat is in the water.

3 Claims, 5 Drawing Sheets

EMERGENCY STEERING CONTROL

This application is a continuation of application Ser. No. 08/449,366, filed May 24, 1995 now abandoned.

FIELD OF THE INVENTION

This invention relates to portable motors for boats and more particularly to steering controls for trolling motors.

BACKGROUND OF THE INVENTION

A trolling motor is a small, quiet motor which is used to propel a fishing boat slowly through the water in a manner designed to not disturb fish. Trolling motors are generally operated electrically with a battery as the power source, thus avoiding the noise associated with gasoline powered motors. As will be discussed more fully below, a trolling motor assembly includes an electric motor and propeller drive which components are connected to the fishing boat by means of a tubular conduit in a manner enabling the axis of the propeller to be pivoted relative to the axis of the conduit for directing the boat's travel. A trolling motor assembly may be positioned either in the bow or the stern of the fishing boat and the propeller normally drives the boat forward in the water.

In order to allow the person steering the boat the free use of both hands for fishing, a trolling motor assembly is typically fitted with a foot-operated steering mechanism. This foot-operated steering mechanism involves a double-acting pivoted foot pedal with a connecting cable set. When the pedal is pressed downward on one end, the cable moves in a first direction and pivots the electric drive motor. Conversely, when the pedal is pressed downward on its other end, the electric drive motor is caused to pivot in the opposite angular direction.

A major problem with such a system is that the cable is prone to breaking, leaving the boat operator unable to control the trolling motor direction. Even if one had a spare cable, the replacement is a long process requiring the boat to be brought to shore and worked on for possibly several hours. Such an occurrence typically destroys the day of fishing. If the day of fishing happened to involve a fishing contest, especially popular today, the chance of competing successfully is also lost.

A trolling motor equipped fishing boat is commonly also fitted with a gasoline powered motor in order to move to a desired general location more quickly than can be done with the trolling motor. However, the gasoline powered motor is not useful for fishing activity in replacement of the trolling motor with a failed steering control because of the noise the gasoline motor generates.

It is therefore an object of this invention to provide an emergency steering controller for a trolling motor to be used in case the foot operated pedal/cable steering mechanism fails.

It is an additional object of this invention to provide an emergency controller for a trolling motor which can be installed quickly and without bringing the boat to shore.

It is a further object of this invention to provide an emergency controller for a trolling motor which will allow the person in the boat to continue with the activity of fishing.

Other objects and advantages will be more fully apparent from the following disclosure and appended claims.

SUMMARY OF THE INVENTION

The present invention provides an apparatus for controlling the direction of a fishing boat powered by a trolling motor in case the typically provided cable-controlled steering mechanism fails. The emergency steering controller has a pair of links one end of which clamp onto a conduit which runs from the steering box above the boat to the electric drive motor beneath the water. The conduit serves to carry connecting electrical cables and to physically mount and orient the trolling motor. The opposite ends of the links are both mounted on a rod which, when assembled, runs substantially vertical and parallel to the motor mount conduit and is rigidly connected at its top end to a horizontal handle. When the handle is moved through an angle, the trolling motor turns through a similar angle. In the preferred embodiment, the handle is able to telescope so it can be made short for storage and long for use. The links are permanently attached to the rod and can be quickly and easily attached to the motor mount conduit when needed. The steering controller can be attached to the motor mount conduit and left in place, if desired.

DETAILED DESCRIPTION OF THE INVENTION

Figure 1:
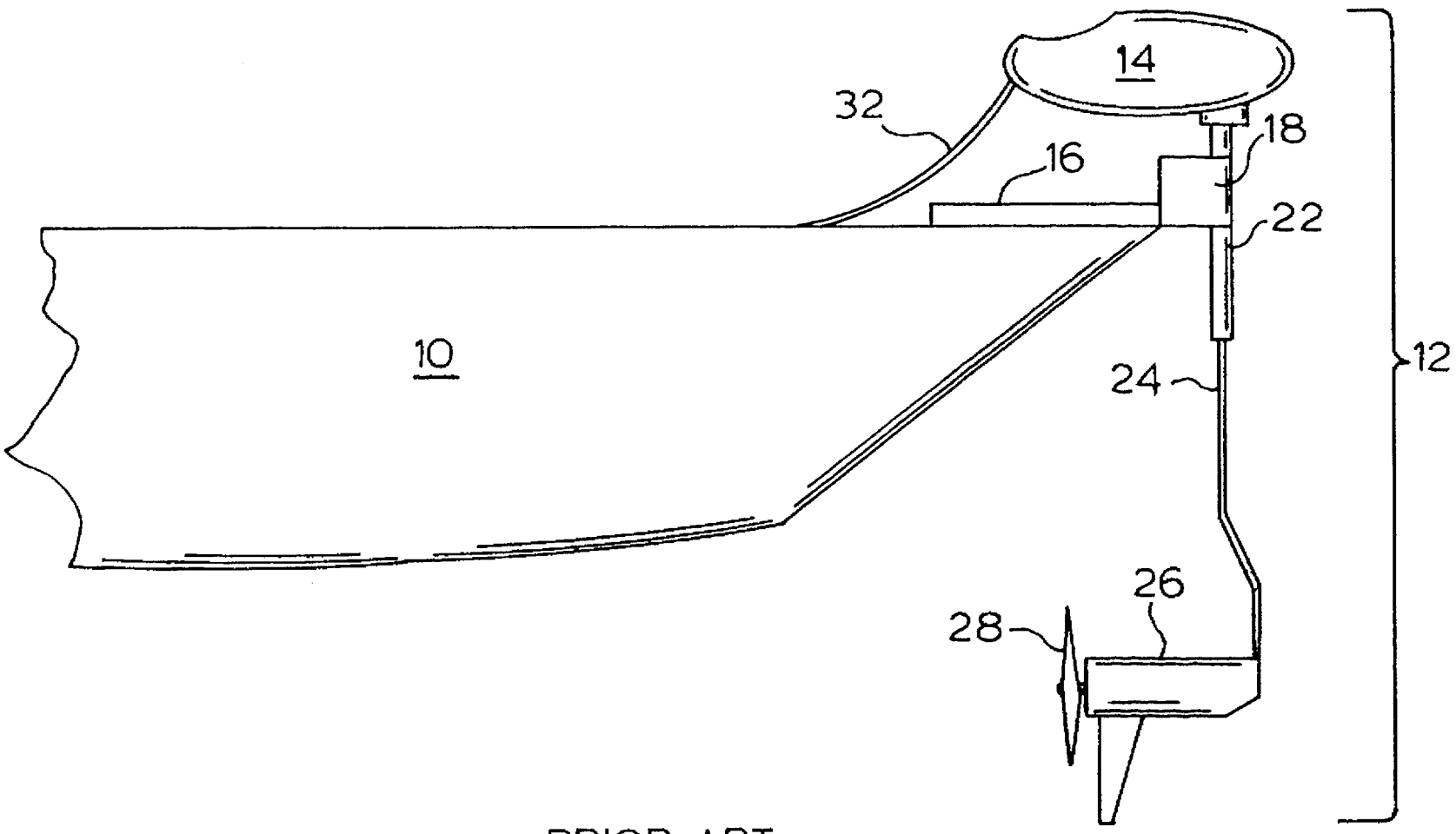
PRIOR ART FIG. 1
FIG. 1 is a side elevation view of a typical trolling motor assembly mounted on the bow of a fishing boat.

According to the brief discussion above, a typical trolling assembly motor mounted on a forward portion of a fishing boat is illustrated in FIG. 1. Trolling motor assembly 12 is shown mounted on the bow of fishing boat 10, but may be, optionally, of a style adapted to mount on the stern of fishing boat 10, and be similarly accommodated with the emergency steering controller of the present invention.

Motor support bracket 16 is secured to the bow of fishing boat 10 and holds pivot block 18 in a position so that mounting sleeve 22 and motor mount conduit 24 are fixed in vertical location. Mounting sleeve 22 is fixed and is thus not free to rotate whereas motor mount conduit 24 is free to rotate when required. The drive force for fishing boat 10 is generated by electric motor 26 and is transmitted through propeller 28. A dual-acting foot pedal (not shown) is connected to steering cable 32 which is operative, in conjunction with steering box 14 to control the direction in which electric motor 26 and propeller 28 are oriented.

If the supplied pedal actuated steering control fails because of a break of cable 32 or other reason, the emergency steering controller of the present invention may be employed.

Figure 4:
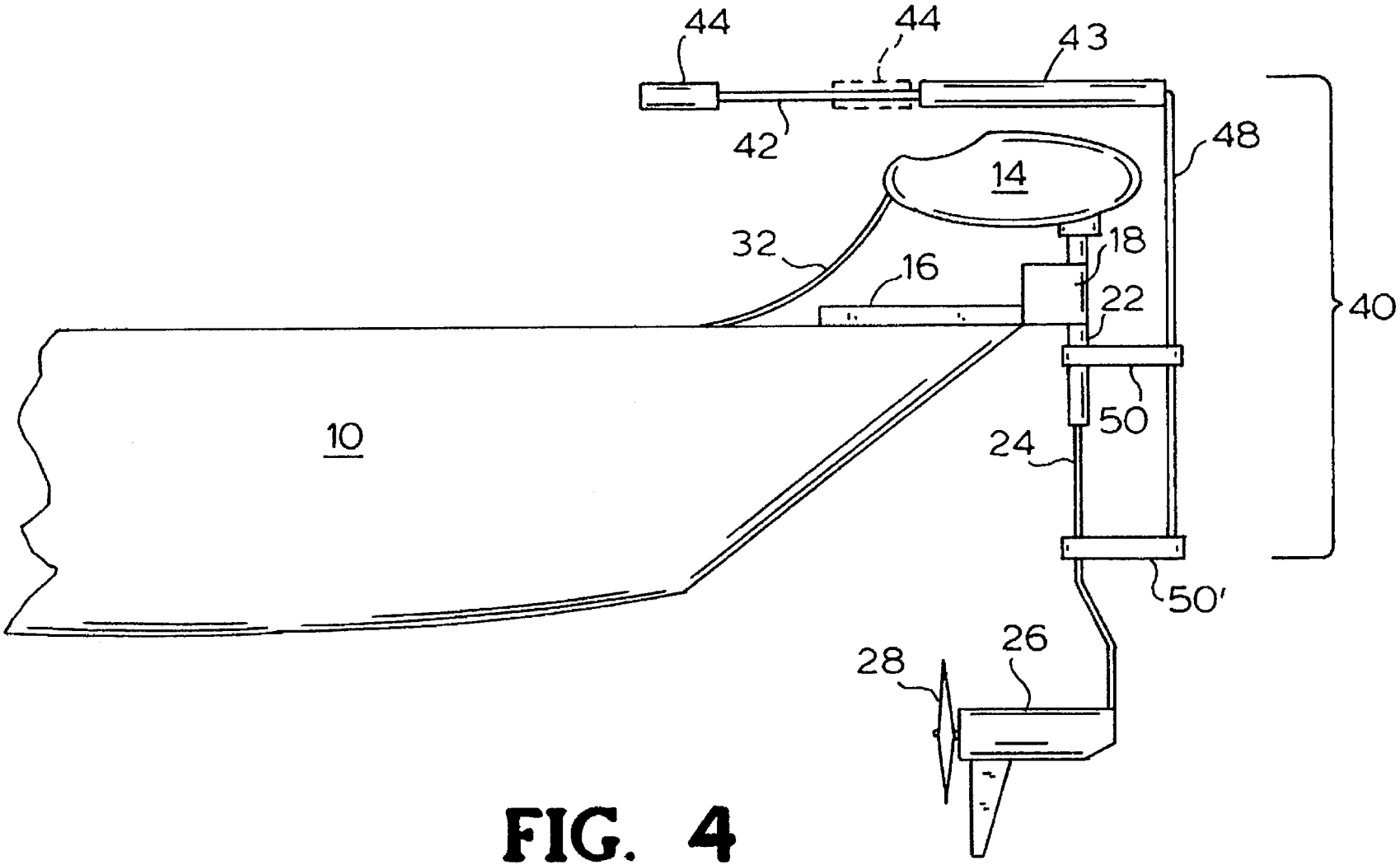
FIG. 4 is the view of FIG. 1 with the addition of the emergency steering controller of the invention mounted on the trolling motor assembly in the manner of a first embodiment.

The emergency steering controller 40 of the invention is depicted in FIG. 4 as installed on the boat and motor assembly of FIG. 1. A pair of links 50, 50' are each fixedly attached at a first end having internal diameter D' (see FIG. 2), to rod 48 which has at its upper end a perpendicularly oriented, fixedly connected, telescoping stem 42 with grip 44. The respective opposite ends of each link 50, 50' are connected at internal diameter D" in a manner which enables motor mount conduit 24 to rotate when grip 44 is moved through a selected angle (see FIG. 7). Since pivot block 18 is fixed and fixedly mounts sleeve 22 sleeve 22 is prevented from rotating. The forward end of upper link 50 is therefore configured so as to be free to rotate in sleeve 22 at its point of connection on sleeve 22. The forward end of lower link 50' however clamps rigidly to motor mount conduit 24 for causing rotation thereof.

Figure 2:
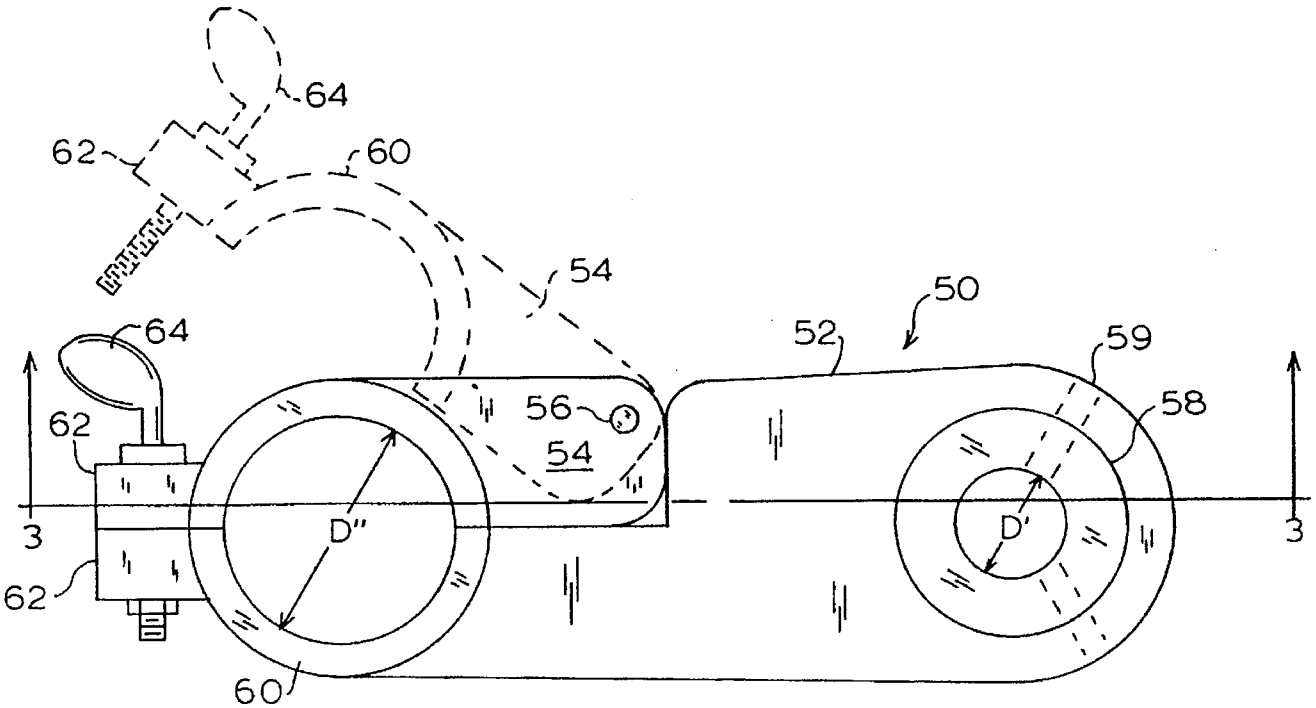
FIG. 2 is a top plan view of a link for connecting the emergency steering controller to the motor mount conduit, according to the invention.
Figure 3:
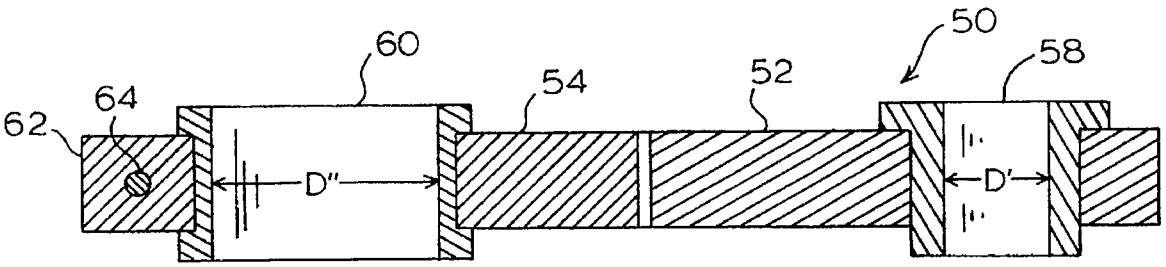
FIG. 3 is a cross sectional view of the link taken in the direction of line 3—3 of FIG. 2.

Link 50, according to the preferred embodiment, is shown in plan view in FIG. 2 and in cross sectional elevation in FIG. 3. Link 50 comprises body 52 with fixedly assembled collar 58 at a first end thereof. Collar 58 has an internal diameter D' for receiving rod 48, and is fitted with one or more set screws 59 for secure engagement between body 52 and rod 48 (see FIG. 4). A pivotable gate 54 assembles to body 52 with pin 56, and gate 54 and body 52 terminate with a pair of lugs 62 through which screw 64 is placed to lock gate 54 in its closed position. One half of split collar 60 is formed as part of body 52 and the other half as part of gate 54 as illustrated in FIG. 2. For purposes of the first embodiment, the inner diameter D" of split collar 60 is sized in upper link 50 to be rotatable about mounting sleeve 22 and in lower link 50' to firmly clamp to motor mount conduit 24 as previously described.

Figure 5:
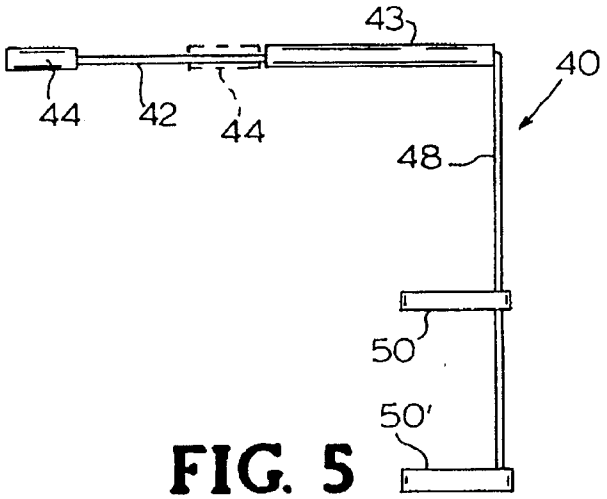
FIG. 5 is a side elevation view of the emergency steering controller of the invention according to the first embodiment.

Emergency steering controller 40 is shown in FIG. 5 dismounted from the boat and trolling motor assembly. In this figure, grip 44 is shown in solid lines in its extended position, with its retracted position shown in dashed lines as stem 42 is telescoped into sleeve 43.

Figure 6:
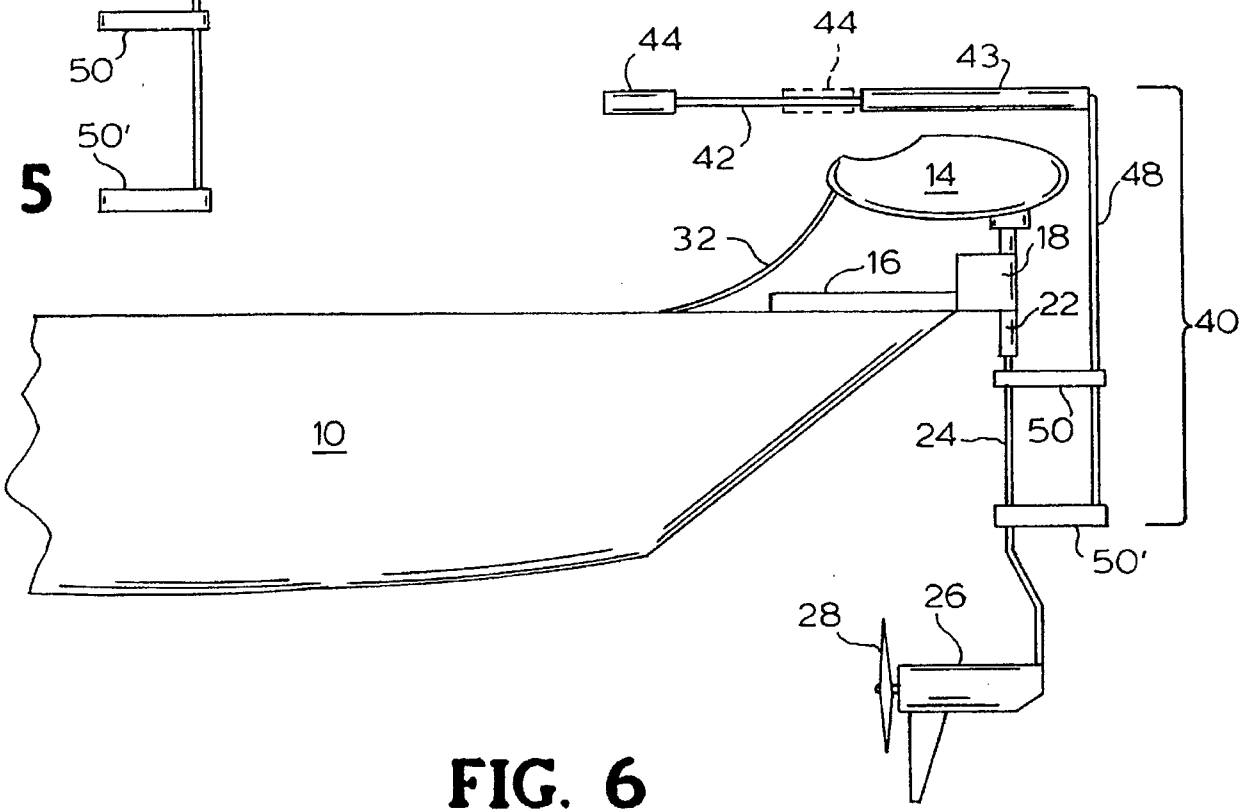
FIG. 6 is a view of FIG. 1 with an emergency steering controller according to a second embodiment of the invention mounted on the motor mount conduit.

A second embodiment of emergency steering controller 40' is illustrated in FIG. 6. The components of the second embodiment are similar to those of the preferred embodiment, the distinction being that the inner ends of both links 50, 50' are securely connected to motor mount conduit 24 by means of set screws 59 (see FIG. 2) or other means, rather than having the inner end of link 50 connected so as to be able to rotate on mounting sleeve 22. The internal diameter of collar 60 is sized accordingly. The choice of the preferred first embodiment or the second embodiment depends, to an extent, on the length of conduit 24 that is exposed beneath mounting sleeve 22. While not shown, it is also recognized that a single link 50 could be employed with one end secured to rod 48 and the opposite end secured to conduit 24.

In either embodiment, emergency steering controller 40 may be mounted on trolling motor assembly 12 quickly and simply without the use of tools while the fishing boat remains in the water. Alternatively, emergency steering controller 40 may be left in place on trolling motor assembly 12 while the original pedal operated cable steering controller is functional and being used, and thus be in readiness for possible use. If left permanently mounted, it is likely that telescoping stem 42 will be kept in its retracted, short, condition.

Figure 7:
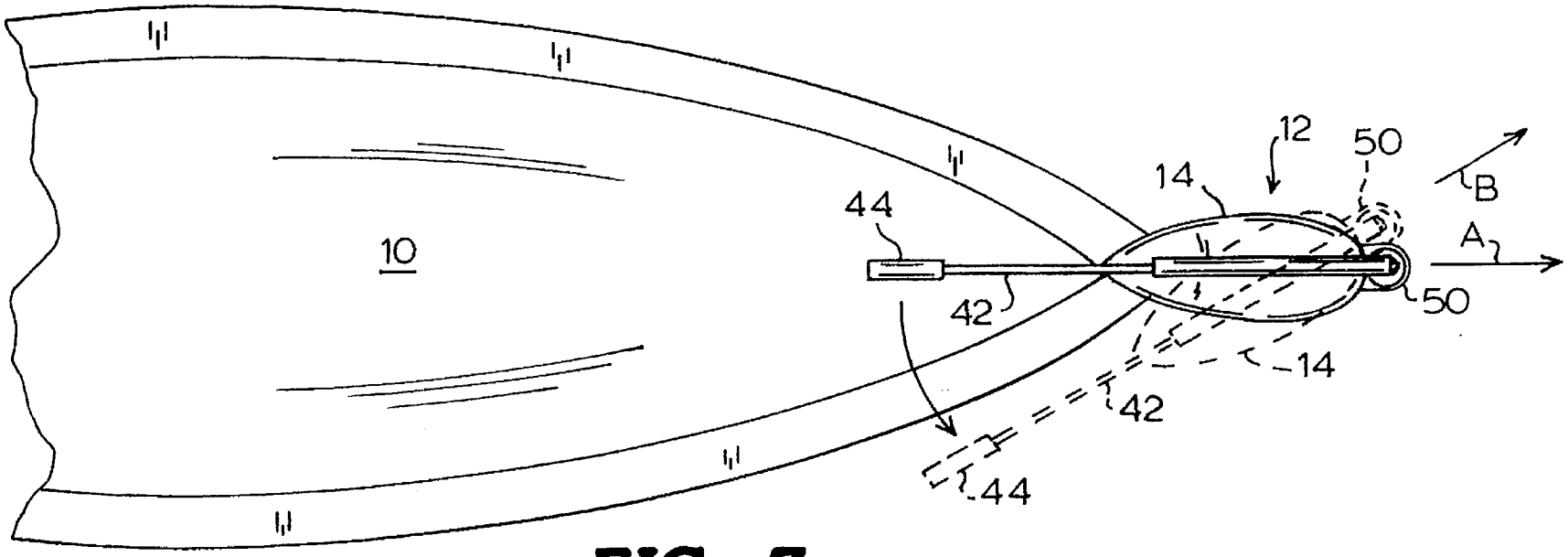
FIG. 7 is a top plan view of the emergency steering controller of the invention mounted on a trolling motor assembly on the bow of a fishing boat and showing the emergency controller for straight forward operation in solid lines and in dashed lines in a position for turning the boat.

The operation of emergency steering controller 40 is best seen by reference to FIG. 7. When mounted on trolling motor assembly 12 and positioned in a forward facing orientation, as indicated by arrow A, controller 40 is positioned as shown in solid lines. When it is desired to cause boat 10 to travel in the direction of arrow B, emergency steering controller 40 is turned as illustrated in dashed lines. Thus, the invention disclosed achieves a steering motion in which trolling motor assembly 12 moves in the same angular direction as does steering controller 40.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. An emergency steering controller for use with a trolling motor assembly having an electric drive motor supported on a lower end of a vertically oriented conduit which is supported at its upper end in a manner which enables the conduit to be rotated and the drive motor to be pivoted for controlling the direction of a boat on which the trolling motor assembly is mounted, said steering controller comprising:

(a) a rod having a lower portion laterally spaced from and extending generally parallel to a lower portion of said conduit forming part of said trolling motor assembly;

(b) a first link having a first end secured to said lower portion of said rod and a second end adapted for being secured to said lower portion of said conduit;

(c) a second link vertically spaced from said first link and having a first end secured to said lower portion of said rod and a second end adapted for being assembled to said conduit; and (d) a handle secured to an upper portion of said rod for causing angular movement of said rod, which angular movement is translated through said first link to rotate said conduit and correspondingly pivot said drive motor in the same angular direction as said rod when said first link second end is secured to said lower portion of said conduit.

2. The emergency steering controller as claimed in claim 1 wherein said second link is adapted to be fixedly assembled to said lower portion of said conduit.

3. The emergency steering controller as claimed in claim 1, wherein said second link is adapted to be rotatably assembled to said conduit.

* * * * *